US008193438B2

(12) United States Patent
Hoshino

(10) Patent No.: US 8,193,438 B2
(45) Date of Patent: Jun. 5, 2012

(54) ELECTRONIC KEYBOARD MUSICAL INSTRUMENT

(75) Inventor: Akihisa Hoshino, Fussa (JP)

(73) Assignee: Casio Computer Co., Ltd, Tokyo (JP)

( * ) Notice: Subject to any disclaimer, the term of this patent is extended or adjusted under 35 U.S.C. 154(b) by 46 days.

(21) Appl. No.: 12/763,328

(22) Filed: Apr. 20, 2010

(65) Prior Publication Data

US 2010/0288110 A1 Nov. 18, 2010

(30) Foreign Application Priority Data

May 18, 2009 (JP) ..... 2009-119636

(51) Int. Cl.
*G10H 1/32* (2006.01)

(52) U.S. Cl. ..... 84/644; 84/670; 84/718; 84/719; 84/743; 84/744

(58) Field of Classification Search ..... 84/644, 84/670, 718, 719, 743, 744
See application file for complete search history.

(56) References Cited

U.S. PATENT DOCUMENTS

| | | | | |
|---|---|---|---|---|
| 1,994,889 | A * | 3/1935 | Hammond, Jr. | 381/118 |
| 2,952,179 | A * | 9/1960 | Andersen | 84/733 |
| 4,245,540 | A * | 1/1981 | Groupp | 84/726 |
| 5,031,500 | A * | 7/1991 | Koike et al. | 84/600 |
| 5,056,400 | A * | 10/1991 | Wachi et al. | 84/600 |
| 5,086,686 | A * | 2/1992 | Misawa et al. | 84/718 |
| 5,189,242 | A * | 2/1993 | Usa | 84/743 |
| 5,247,129 | A * | 9/1993 | Nozaki et al. | 84/615 |
| 5,248,846 | A * | 9/1993 | Koike et al. | 84/718 |
| 5,308,937 | A * | 5/1994 | Torii | 181/141 |
| 5,335,283 | A * | 8/1994 | Torii | 381/118 |
| 6,084,167 | A * | 7/2000 | Akimoto et al. | 84/477 R |
| 7,002,070 | B2 * | 2/2006 | Katz | 84/718 |

(Continued)

FOREIGN PATENT DOCUMENTS

CN 1641744 A 7/2005

(Continued)

OTHER PUBLICATIONS

Japanese Office Action for Japanese Application No. 2009-119636 mailed on Aug. 9, 2011.

(Continued)

*Primary Examiner* — David S. Warren
(74) *Attorney, Agent, or Firm* — Turocy & Watson, LLP

(57) ABSTRACT

An electronic keyboard musical instrument which is placed on a supporting surface when it is used, includes an instrument main unit which includes a keyboard having a plurality of keys and which generates electrical signals in response to depressions of the keys, a speaker which has a front side and a rear side and which produces sounds corresponding to the electrical signals from the instrument main unit, and an instrument main unit supporting member which is placed on the supporting surface. The instrument main unit supporting member includes an outer surface facing an external space, an internal space surrounded by the outer surface and housing the instrument main unit at a position apart upward from the supporting surface, and an opening formed in the outer surface and communicating the internal space with the external space. The speaker is attached to the outer surface with the front side facing the opening.

4 Claims, 5 Drawing Sheets

U.S. PATENT DOCUMENTS

| | | | | |
|---|---|---|---|---|
| 7,329,812 | B2 * | 2/2008 | Kuwahara et al. | 84/744 |
| 7,514,625 | B2 * | 4/2009 | Suzuki | 84/723 |
| 7,678,988 | B2 * | 3/2010 | Sato et al. | 84/743 |
| 7,692,089 | B2 * | 4/2010 | Nishida | 84/644 |
| 7,745,719 | B2 * | 6/2010 | Suzuki | 84/625 |
| 2003/0015086 | A1 * | 1/2003 | Katz | 84/644 |
| 2003/0126975 | A1 * | 7/2003 | Urai et al. | 84/737 |
| 2004/0173086 | A1 * | 9/2004 | Sato et al. | 84/745 |
| 2007/0028755 | A1 * | 2/2007 | Suzuki | 84/746 |
| 2008/0072747 | A1 * | 3/2008 | Nishida | 84/744 |
| 2009/0038469 | A1 * | 2/2009 | Suzuki | 84/744 |

FOREIGN PATENT DOCUMENTS

| | | | |
|---|---|---|---|
| CN | 101042860 | A | 9/2007 |
| JP | 3130697 | | 12/1991 |
| JP | 08054880 | | 2/1996 |
| JP | 2000081885 | | 3/2000 |

OTHER PUBLICATIONS

Chinese Office Action for Chinese Application No. 201010177700X mailed on Feb. 16, 2012.

* cited by examiner

ELECTRONIC KEYBOARD MUSICAL INSTRUMENT

CROSS-REFERENCE TO RELATED APPLICATIONS

This application is based upon and claims the benefit of priority from prior Japanese Patent Application No. 2009-119636, filed May 18, 2009, the entire contents of which are incorporated herein by reference.

BACKGROUND OF THE INVENTION

1. Field of the Invention

The present invention relates to an electronic keyboard musical instrument which is placed on a supporting surface when it is used.

2. Description of the Related Art

Japanese Patent Application KOKAI Publication No. 2000-81885 discloses an electronic keyboard musical instrument which is placed on a supporting surface such as a floor of a building when it is use. The electronic keyboard musical instrument comprises an instrument main unit 11 which includes a keyboard having a plurality of keys and which generates electrical signals in response to depressions of the keys of the keyboard; speakers 21 which produce sounds corresponding to the electrical signals from the instrument main unit; and an instrument main unit supporting member which is placed on the supporting surface and which supports the instrument main unit 11 at a position apart upward from the supporting surface. The instrument main unit supporting member includes: a main unit housing 10 which has an outer surface facing an external space and an internal space surrounded by the outer surface; and a pair of side plates 30 which is placed on the supporting surface and which supports the main unit housing 10 at a position apart upward from the supporting surface. And, the instrument main unit 11 is housed in the internal space of the main unit housing 10.

A lower surface region of the outer surface of the main unit housing 10, facing the supporting surface, is provided by a shelf plate 12 of the main unit housing 10. The shelf plate 12 is provided with openings 12*a* in a rearward of the instrument main unit 11, and the openings 12*a* make the internal space of the main unit housing 10 being communicate with the external space. The speakers 21 are located below the openings 12*a* and housed in a speaker box 20 supported by the side plates 30. In the speaker box 20, a front side of each speaker 21 faces obliquely downward and forward, and a rear side of each speaker 21 faces each opening 12*a*.

In such the electronic keyboard musical instrument disclosed in the Japanese Patent Application KOKAI Publication No. 2000-81885, sounds which are produced by the speakers 21 when a player facing the keyboard presses the keys of the keyboard are reflected by the supporting surface facing the front sides of the speakers 21 so that the player hears the reflected sounds from the feet of the player, and at the same time, the player hears the sounds from the internal space of the main unit housing 10 through the openings 12*a* of the outer surface of the main unit housing 10 facing the rear sides of the speakers 21.

The front side of each speaker 21 transmits the sound produced by each speaker 21 most effectively, but the sound from the front side of each speaker 21 is always reflected by the supporting surface so that a quality of the sound is degraded. Since a means for driving a diaphragm of the speaker 21 is provided on the rear side of the speaker 21, a quality of the sound from the rear side of the speaker 21 is degraded in comparison with the quality of the sound from the front side of the speaker 21. Further, in the electronic keyboard musical instrument of the Japanese Patent Application KOKAI Publication No. 2000-81885, the rear side of each speaker 21 is located apart downward from each opening 12*a* in the outer surface of the main unit housing 10. Therefore, the quality of the sound transmitted from the rear side of each speaker to the internal space of the main unit housing 10 through each opening 12*a* is further degraded in comparison with the quality of the sound from the front side of each speaker 21.

The speaker box 20 which is supported by the side plates 30 below the main unit housing 10 and which houses the speakers 21 complicates the structure of the instrument main unit supporting member, increases the weight of the instrument main unit supporting member, and increases the manufacturing cost of the instrument main unit supporting member.

Japanese Patent Application KOKAI Publication No. 8-54880 also discloses an electronic keyboard musical instrument which is placed on a supporting surface when it is used. The electronic keyboard musical instrument comprises an instrument main unit which includes a keyboard 12 having a plurality of keys and which generates electrical signals in response to depressions of the keys of the keyboard; three speakers 14A, 14B and 15 which produce sounds corresponding to the electrical signals from the instrument main unit; and an instrument main unit supporting member which includes upper and lower parts 10 and 11, which are placed on a supporting surface 20 such as an upper surface of a table and which support the instrument main unit at a position apart upward from the supporting surface 20.

The upper part of the instrument main unit supporting member comprises a main unit housing 10 which includes an outer surface facing an external space, and an internal space which is surrounded by the outer surface and which houses the instrument main unit. The lower part 11 of the instrument main unit supporting member comprises a plurality of side plates 17 which is placed on the supporting surface 20 and which supports the main unit housing 10 at a position apart upward from the supporting surface 20.

Three speakers 14A, 14B and 15B are housed in the internal space of the main unit housing 10. In the internal space, two speakers 14A and 14B are fixed to an inner surface of the internal space with their front sides facing two openings formed in an upper surface region of the outer surface of the main unit housing 10, and the keyboard 12 is exposed in the upper surface region. A lower surface region of the outer surface of the main unit housing 10, facing the supporting surface 20, is provided by a bottom plate 16 of the main unit housing 10. Further in the internal space, one speaker 15 is fixed to the inner surface of the internal space with its front side facing one opening formed in the bottom plate 16.

A manufacturing cost of the electronic keyboard musical instrument of Japanese Patent Application KOKAI Publication No. 8-54880 is increased by using the speakers which transmit sounds only in directions in which the front sides of the speakers face from the outer surface of the main unit housing 10 of the instrument main unit supporting member, like the speakers 14A and 14B whose front sides face upward and the speaker 15 whose front side faces downward.

Further, the main unit housing 10 having the internal space in which the speakers 14A, 14B and 15 and the instrument main unit including the keyboard 12 are housed has large outer dimensions, and a weight of the main unit housing 10 is heavy.

Japanese Utility Model Application KOKAI Publication No. 3-130697 discloses an instrument main unit supporting member for an electronic keyboard musical instrument, which is placed on a supporting surface like a floor of a building when the electronic keyboard musical instrument is used. The instrument main unit supporting member comprises a shelf plate 1 at a position apart upward from a supporting surface, and an instrument main unit which includes a keyboard having a plurality of keys and which generates electrical signals in response to depressions of the keys of the keyboard is placed on the shelf plate 1. The instrument main unit supporting member supports a speaker box 2 adjacent to a lower surface region of the shelf plate 1, the lower surface region facing the supporting surface. The speaker box 2 houses two speakers 6 in its internal space with their front sides facing the lower surface region, and two openings 8 are formed in the shelf plate 1 to correspond to the front sides of the speakers 6. Ducts 7 for bass sounds are opened in a front surface region of the outer surface of the speaker box 2, the front surface region facing a player of the electronic keyboard musical instrument.

The speaker box 2 housing two speakers 6 and 6 in its internal space complicates a structure of the instrument main unit supporting member and increases outer dimensions of the instrument main unit supporting member.

BRIEF SUMMARY OF THE INVENTION

An object of the present invention is to provide an electronic keyboard musical instrument in which its whole structure is simplified and by which a player hears sounds in high quality when the player operates a keyboard and produces the sounds by a speaker.

In order to achieve the above described object, an electronic keyboard musical instrument which is according to one aspect of the present invention and which is placed on a supporting surface when it is used, comprises an instrument main unit which includes a keyboard having a plurality of keys and which generates electrical signals in response to depressions of the keys of the keyboard; a speaker which has a front side and a rear side and which produces sounds corresponding to the electrical signals from the instrument main unit; and an instrument main unit supporting member which is placed on the supporting surface. The instrument main unit supporting member includes an outer surface facing an external space, an internal space surrounded by the outer surface and housing the instrument main unit at a position apart upward from the supporting surface, and an opening formed in the outer surface and communicating the internal space with the external space. And, the speaker is attached to the outer surface with the front side facing the opening.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out herein after.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
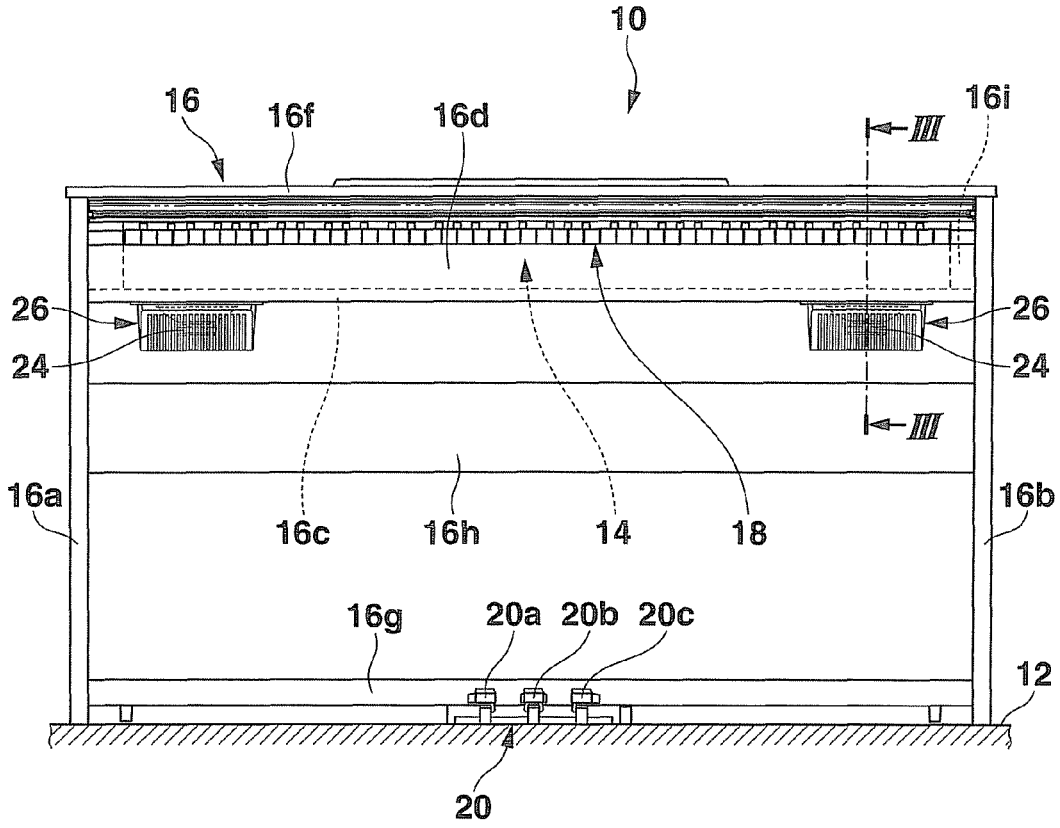
FIG. 1 is a schematic front view of an electronic keyboard musical instrument according to an embodiment of the present invention.
Figure 2:
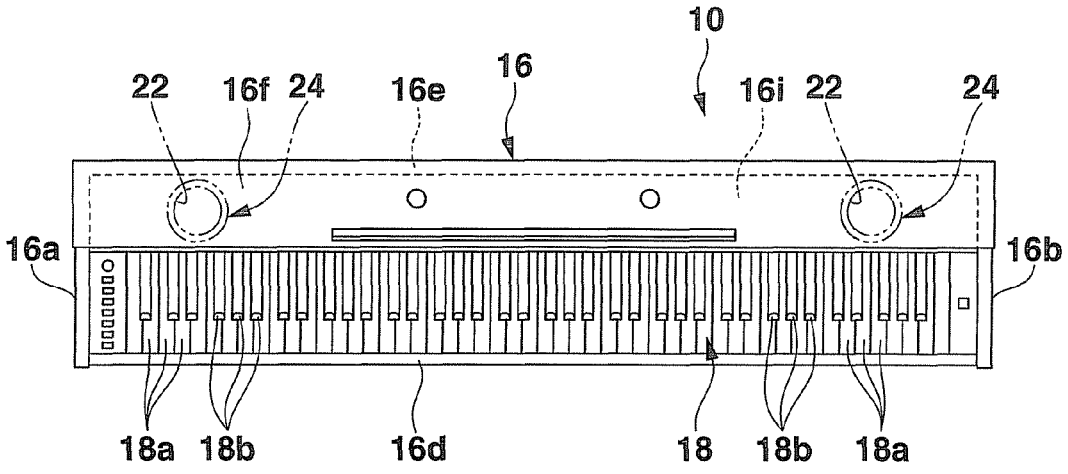
FIG. 2 is a schematic plan view of the electronic keyboard musical instrument of FIG. 1.
Figure 3:
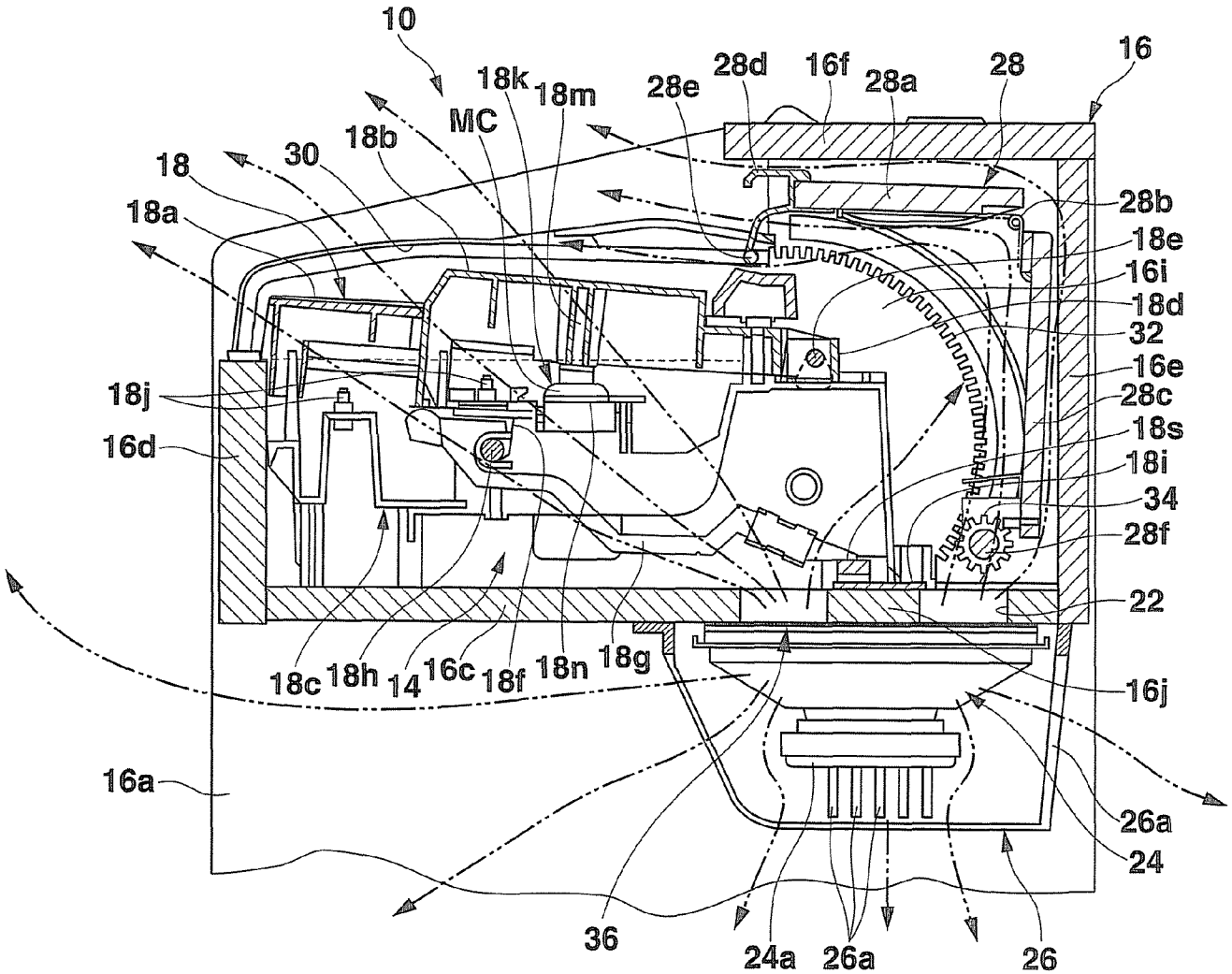
FIG. 3 is a schematic cross-sectional view along a line in FIG. 1, in which a fallboard is opened.

FIGS. 1 and 2 show schematic front and plan views of a whole electronic keyboard musical instrument 10 according to an embodiment of the present invention. The electronic keyboard musical instrument 10 is placed on a supporting surface 12 such as a floor of a building when it is used. As the electronic keyboard musical instrument 10, an electronic piano or organ is well known. FIG. 3 shows a schematic cross-sectional view along a line in FIG. 1.

As shown in FIGS. 1 and 2, the electronic keyboard musical instrument 10 comprises an instrument main unit 14 and an instrument main unit supporting member 16 which supports the instrument main unit 14 at a position apart upward from the supporting surface 12. The instrument main unit 14 includes a keyboard 18 having white keys 18*a* and black keys 18*b* arranged in a predetermined order, and generates electrical signals in response to depressions of the white keys 18*a* and black keys 18*b* of the keyboard 18. Such an instrument main unit 14 is well known and a detailed explanation thereof is omitted.

The instrument main unit supporting member 16 comprises a pair of side plates 16*a* and 16*b*, a bottom plate 16*c*, a front plate 16*d*, a rear plate 16*e*, and a top plate 16*f*. The side plates 16*a* and 16*b* stand vertically from the supporting surface 12 in left and right sides of a player of the electronic keyboard musical instrument 10. The bottom plate 16*c* extends horizontally between the side plates 16*a* and 16*b* at a position apart upward from the supporting surface 12 at a predetermined distance, and both ends of the bottom plate 16*c* are fixed to the side plates 16*a* and 16*b*. The front plate 16*d* rises vertically from a front end of the bottom plate 16*c* to a predetermined position lower than upper ends of the side plates 16*a* and 16*b* between the side plates 16*a* and 16*b*, and both ends of the front plate 16*d* are fixed to the side plates 16*a* and 16*b*. The rear plate 16*e* rises vertically from a rear end of the bottom plate 16*c* to the upper ends of the side plates 16*a* and 16*b* between the side plates 16*a* and 16*b*, and both ends of the rear plate 16*e* are fixed to the side plates 16*a* and 16*b*. And, the top plate 16*f* is fixed to rear halves of the upper ends of the side plates 16*a* and 16*b* and to an upper end of the rear plate 16*e*, and covers substantially a rear half of the upper surface of the bottom plate 16*c*.

In this embodiment, an outer surface of the instrument main unit supporting member 16 includes a lower surface region, an upper surface region, a front surface region, a rear surface region, and both side surface regions. The lower surface region is provided by the bottom plate 16*c* and faces the supporting surface 12. The upper surface region is provided by the top plate 16*f*, faces opposite to the lower surface region, and exposes the white keys 18*a* and black keys 18*b* of the keyboard 18. The front surface region is provided by the front plate 16*d* and faces a player of the keyboard 18 of the electronic keyboard musical instrument 10. The rear surface region is provided by the rear plate 16*e* and faces opposite to the front surface region. And, the both side surface regions are provided by the side plates 16*a* and 16*b* and face in both side directions of the front surface region at both side ends of the front surface region.

The instrument main unit supporting member 16 further comprises a lower end reinforcing member 16*g* and an intermediate reinforcing member 16*h*. The lower end reinforcing member 16*g* extends horizontally between the side plates 16*a* and 16*b* at a position near lower and rear ends of the side plates 16*a* and 16*b*, and both ends of the lower end reinforcing member 16*g* are fixed to the side plates 16*a* and 16*b*. The intermediate reinforcing member 16*h* is located between the lower end reinforcing member 16*g* and the rear plate 16*e* at the rear ends of the side plates 16*a* and 16*b* and extends horizontally between the side plates 16*a* and 16*b*, and both ends of the intermediate reinforcing member 16*h* are fixed to the side plates 16*a* and 16*b*.

An internal space 16*i* is provided between upper parts of the side plates 16*a* and 16*b* which are located upward from the bottom plate 16*c*. The internal space 16*i* is surrounded by the upper parts of the side plates 16*a* and 16*b*, the front plate 16*d*, the bottom plate 16*c*, the rear plate 16*e*, and the top plate 16*f*. The top plate 16*f* covers only an upper part of a rear half of the internal space 16*i*, and an upper part of a front half of the internal space 16*i* is exposed to an external space.

The instrument main unit 14 is located in the internal space 16*i*, and the instrument main unit 14 is supported on an upper surface of the bottom plate 16*c*. Upper surfaces of the white keys 18*a* and black keys 18*b* of the keyboard 18 of the instrument main unit 14 are exposed upward in the front half of the internal space 16*i*.

A pedal unit 20 including pedals 20*a*, 20*b* and 20*c* is provided at a longitudinally middle part of the lower end reinforcing member 16*g*. The pedal unit 20 is electrically connected to the instrument main unit 14 in the internal space 16*i* by not-shown wiring extending in the lower end reinforcing member 16*g* and one of the side plates 16*a* and 16*b* to the internal space 16*i*. When the player selectively presses the pedals 20*a*, 20*b* and 20*c* of the pedal unit 20 by its foot, the instrument main unit 14 modulates electrical signals which are generated by the instrument main unit 14 when the player presses the white keys 18*a* and black keys 18*b* of the keyboard 18. Such a combination of the pedal unit 20 and the instrument main unit 14 is well known.

A plurality of openings 22 are formed in the outer surface of the instrument main unit supporting member 16, and the openings 22 communicate the internal space 16*i* with the external space. In this embodiment, a pair of openings 22 is formed in a rear half of the lower surface region of the bottom plate 16*c* at positions near both side ends of the bottom plate 16*c*.

A plurality of speakers 24 are attached to the outer surface with their front sides facing the openings 22. The rear sides of the speakers 24 are projected from the outer surface into the external space. A well known speaker drive unit 24*a* is provided on the rear side of each speaker 24. The speaker drive unit 24*a* is electrically connected to the instrument main unit 14 in the internal space 16*i* by not-shown wiring, and produces sounds corresponding to the electrical signals from the instrument main unit 14 by the speaker 24. The shape of each opening 22 can be optionally defined as long as qualities of the sounds produced from the speaker 24 corresponding thereto and transmitted through the openings 22 are not degraded.

A speaker protective cover 26 which covers each speaker 24 on a peripheral area around each opening 22 is fixed by a known fixing means to the outer surface of the instrument main unit supporting member 16, that is, the lower surface region of the bottom plate 16*c* in this embodiment. The speaker protective cover 26 is configured to protect the speaker 24 from an external force and to transmit substantially all registers of the sounds from the rear side of the speaker 24.

Figure 5:
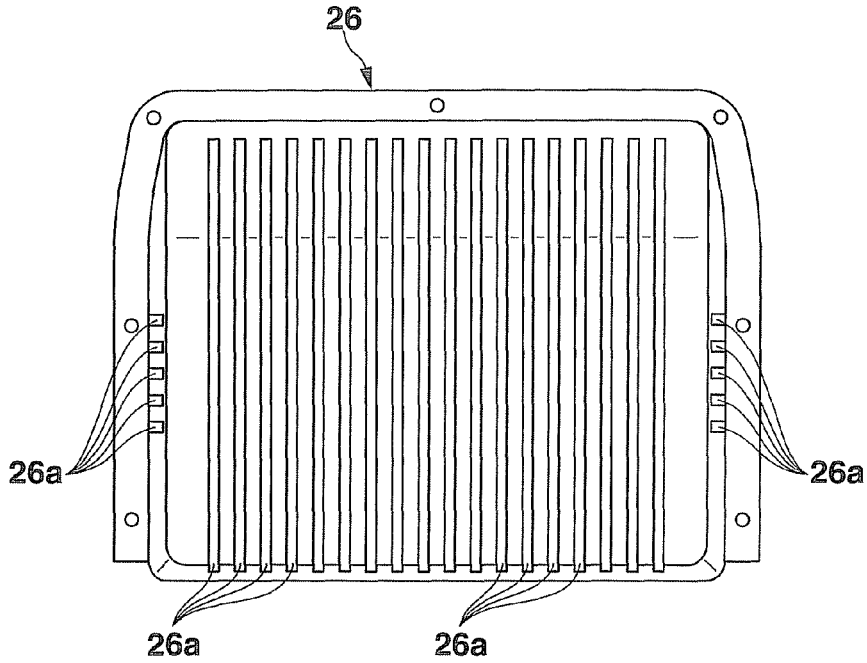
FIG. 5 is a schematic enlarged bottom view of a speaker cover, the speaker cover being fixed to a bottom plate providing a lower surface region of an outer surface of an instrument main unit supporting member in the electronic keyboard musical instrument of FIG. 1.

As shown in FIG. 5, the speaker protective cover 26 of this embodiment is shaped like a box without a lid, and has sound radiating slits 26*a* in its front surface, rear surface, side surfaces, and bottom surface. The speaker protective cover 26 can be made of metal, wood, synthetic resin, or other various known materials, or by combining any of them. Further, the speaker protective cover 26 can be shaped like a cage having sound radiating openings.

Next, a structure of a main part of the electronic keyboard musical instrument 10 the whole structure of which has been described above with reference to FIGS. 1 and 2, will be described with reference to FIGS. 3 to 8B.

As shown in FIG. 3, the keyboard 18 comprises a keyboard chassis 18*c* at a predetermined position along the front plate 16*d* on the inner surface of the bottom plate 16*c* of the instrument main unit supporting member 16. The white keys 18*a* and black keys 18*b* are arranged in a predetermined order on the keyboard chassis 18*c*, and a key supporting portion 18*d* is provided at a top of a rear end part of the keyboard chassis 18*c*. Rear end parts of the white keys 18*a* and black keys 18*b* are supported by the key supporting portion 18*d* at the top of the rear end part of the keyboard chassis 18*c* through a rotation shaft 18*e*. Therefore, front end parts of the white keys 18*a* and black keys 18*b* are vertically movable to the keyboard chassis 18*c* in a predetermined range.

A hammer supporting portion 18*f* is provided on a part of the keyboard chassis 18*c* which is located below the longitudinal middle part of each white key 18*a* and the front end part of each black key 18*b*. And, front end parts of hammer members 18*g* corresponding to the white keys 18*a* and black keys 18*b* are supported rotationally in the vertical direction on the hammer supporting portion 18*f* by a rotation shaft 18*h*.

Rear end parts of the hammer members 18*g* extend to a bottom of the rear end part of the keyboard chassis 18*c*, and support weights. On the bottom of the rear end part of the keyboard chassis 18*c*, a stopper fixing portion 18*i* is provided to extend along the rear half of the inner surface of the bottom plate 16*c* in a direction in which the white keys 18*a* and black keys 18*b* are arranged. A stopper 18*s* made of a known shock-absorbing material such as a felt is attached on the upper surface of the stopper fixing portion 18*i* to correspond to the rear end parts of the hammer members 18*g*.

While a pressing force is not applied to any of the white keys 18*a* and black keys 18*b*, as shown in FIG. 3, the white keys 18*a* and black keys 18*b* are placed on the front end parts of the hammer members 18*g* with their rear end parts contacting the stopper 18*s*. As a result, the white keys 18*a* and black keys 18*b* stand still at their predetermined initial positions.

When any of the white keys 18*a* and black keys 18*b* is pressed by a finger of the player, the pressed white key 18*a* or black key 18*b* presses down the front end part of the hammer member 18*g* corresponding thereto, and the corresponding hammer member 18*g* is rotated on the rotation shaft 18*h* supported by the hammer supporting portion 18*f* to move its rear end part upward from the stopper 18*g*. At this time, the rotating hammer member 18*g* applies a force of repulsion to the pressed white key 18*a* or black key 18*b*, based on the principle of leverage, so that the finger of the player pressing the white key 18*a* or black key 18*b* can feel a so-called key touch-feeling.

Figure 8A:
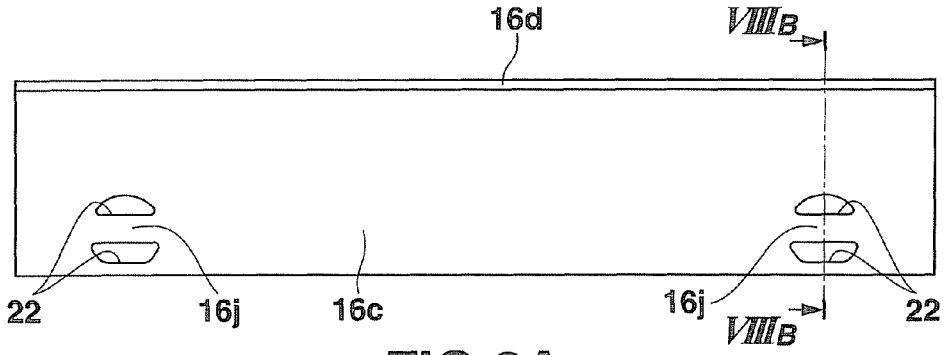
FIG. 8A is a schematic bottom view of the bottom plate of FIG. 7A, in which the opening reinforcing members corresponding to two speakers are removed and the openings corresponding to two speakers are exposed.
Figure 8B:
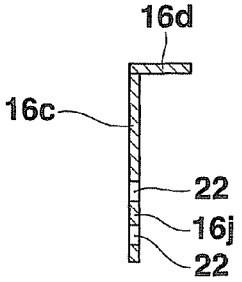
FIG. 8B is a schematic cross-sectional view along a line VIIIB-VIIIB in FIG. 8A.

In this embodiment, each of the openings 22 at the both side regions of the rear half of the bottom plate 16*c* of the instrument main unit supporting member 16 is divided into front and rear parts by a bridge-shaped part 16*j* that is a part of the bottom plate 16*c*, as shown in FIGS. 3, 8A and 8B. Further, as shown in FIG. 3, both ends of the stopper fixing portion 18*i* at the bottom of the rear end part of the keyboard chassis 18*c* are placed on the bridge-shaped parts 16*j* of the openings 22.

In this embodiment, the hammer members 18*g* provide key-responsive moving members which move in response to the depressions of the white keys 18*a* and black keys 18*b*, and each bridge-shaped part 16*j* provides a part of a moving range restricting member which is provided on the instrument main unit supporting member 16 to cross each opening 22 in the instrument main unit supporting member 16 and which contacts the hammer members 18*g* as the key-responsive moving members to restrict moving ranges of the hammer members 18*g*.

In this embodiment, the white keys 18*a* and black keys 18*b* are made of a known light transmissive material such as plastic. Well known light-emitters 18*j* such as LEDs (light-emitting diodes) are arranged below the front end parts of the white keys 18*a* and black keys 18*b* on the keyboard chassis 18*c*.

Further, well known switches 18*k* are arranged under the middle parts of the white keys 18*a* and black keys 18*b* on the keyboard chassis 18*c*. Switch pressing portions 18*m* are provided on the lower surfaces of the middle parts of the white keys 18*a* and black keys 18*b* to extend toward the switches 18*k* corresponding thereto. These switches 18*k* are attached to a control circuit board 18*n* supported by the keyboard chassis 18*c* and including a control circuit for the instrument main unit 14. The control circuit of the control circuit board 18*n* is connected to a not-shown external electric power source by a not-shown power cord.

More precisely, in this embodiment, each switch 18*k* includes a not-shown fixed contact which is located at a position corresponding to each switch pressing portion 18*m* on the control circuit substrate 18*n*, and a movable contact member MC which is provided by an elastic body formed in a predetermined shape such as a dome or cup-shaped rubber and which is attached to the control circuit substrate 18*n* to cover the fixed contact. The movable contact member MC has a not-shown movable contact corresponding to the fixed contact.

As described above, the speaker drive unit 24*a* of each speaker 24 is electrically connected to the control circuit of the control circuit board 18*n* of the instrument main unit 14 by the not-shown wiring, and the control circuit is electrically connected to the light-emitters 18*j* by not-shown wirings.

In this embodiment, the instrument main unit supporting member 16 further comprises a fallboard 28 which is arranged to open and close the upper opening of the front half of the internal space 16*i* of the instrument main unit supporting member 16, the upper opening exposing the upper surfaces of the white keys 18*a* and black keys 18*b* of the keyboard 18. The fallboard 28 includes a front lid part 28*a* and a rear lid part 28*c* connected to the front lid part 28*a* with a hinge 28*b*.

A front lid part moving guide groove 30 is formed in the upper end part of the inside surface of each of the side plates 16*a* and 16*b* of the instrument main unit supporting member 16, and extends along a front half of an upper end of each of the side plates 16*a* and 16*b* from a position just under a front end of the top plate 16*f* to an upper end of the front plate 16*d*. A handle 28*d* is attached to a front edge of the front lid part 28*a*. The handle 28*d* supports a front lid part moving guide shaft 28*e* whose both ends are inserted into the front lid part moving guide grooves 30 of the side plates 16*a* and 16*b* to slide therein.

Further, a curved rack gear 32 for guiding a movement of the rear lid part 28*c* is supported by the upper end part of the inside surface of each of the side plates 16*a* and 16*b* of the instrument main unit supporting member 16. The curved rack gear 32 is curved downward from the position just under the front end of the top plate 16*f* to a position near a lower end of an inner surface of the rear plate 16*e*. A rear end of the rear lid part 28*c* supports a rear lid part moving guide shaft 28*f*, and a pair of small gears 34 meshing with the curved rack gears 32 of the side plates 16*a* and 16*b* is supported to be rotational by both ends of the guide shaft 28*f*.

As shown in FIG. 3, when the both ends of the front lid part moving guide shaft 28*e* are located at the rear ends of the front lid part moving guide grooves 30 of the side plates 16*a* and 16*b*, the small gears 34 on the both ends of the rear lid part moving guide shaft 28*f* are located at the rear ends of the curved rack gears 32. At this time, the front lid part 28*a* is located just under the top plate 16*f* and along the inner surface of the top plate 16*f*, and the rear lid part 28*c* is located adjacent to the inner surface of the rear plate 16*e* and along the inner surface of the rear plate 16*e*. Therefore, the front lid part 28*a* and rear lid part 28*c* of the fallboard 28 do not cover the upper opening of the front half of the internal space 16*i* of the instrument main unit supporting member 16 and exposes the upper surfaces of the white keys 18*a* and black keys 18*b* of the keyboard 18 upward. And, the fallboard 28 is located at its open position.

Figure 4:
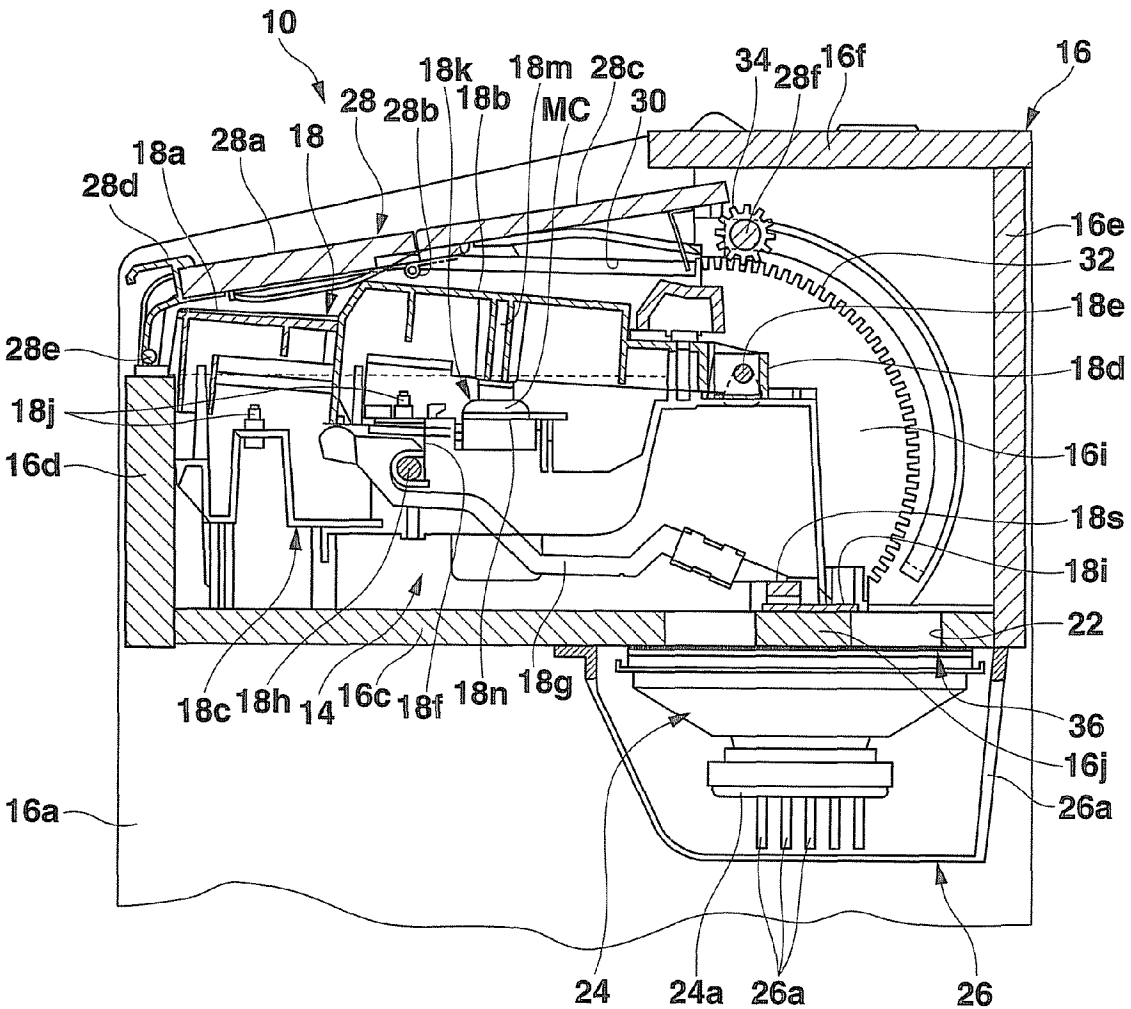
FIG. 4 is a schematic cross-sectional view similar to FIG. 3, in which the fallboard is closed.

The fallboard 28 located at its open position as shown in FIG. 3 can be pulled out to the upper opening of the front part of the internal space 16*i* of the instrument main unit supporting member 16 by pulling out the handle 28*d* at the front end of the front lid part 28*a* into the upper opening and following the rear lid part 28*c* into the upper opening. Finally, as shown in FIG. 4, the front lid part 28*a* and rear lid part 28*c* of the fallboard 28 cover the upper opening of the front half of the internal space 16*i* of the instrument main unit supporting member 16 when the both ends of the front lid part moving guide shaft 28*e* are located at the front ends of the front lid part moving guide grooves 30 of the side plates 16*a* and 16*b* and the small gears 34 at the both ends of the rear lid part moving guide shaft 28*f* are located at the front ends of the curved rack gears 32. At this time, the upper surfaces of the white keys 18*a* and black keys 18*b* of the keyboard 18 are not exposed to the external space through the upper opening. And, the fallboard lid 28 is located at its closed position.

Figure 6A:
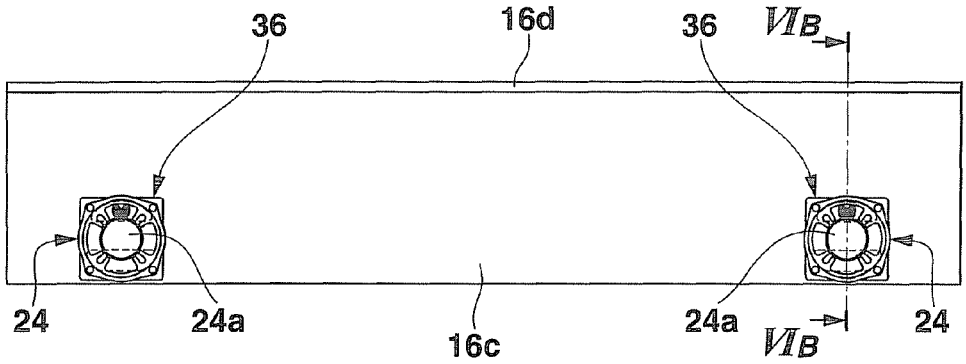
FIG. 6A is a schematic bottom view of the bottom plate providing the lower surface region of the outer surface of the instrument main unit supporting member in the electronic keyboard musical instrument of FIG. 1, in which two speaker protective covers each shown in FIG. 5 are removed and two speakers are exposed.
Figure 6B:
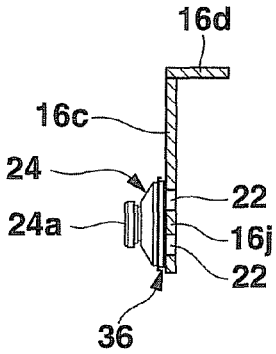
FIG. 6B is a schematic cross-sectional view along a line VIB-VIB in FIG. 6A.
Figure 7A:
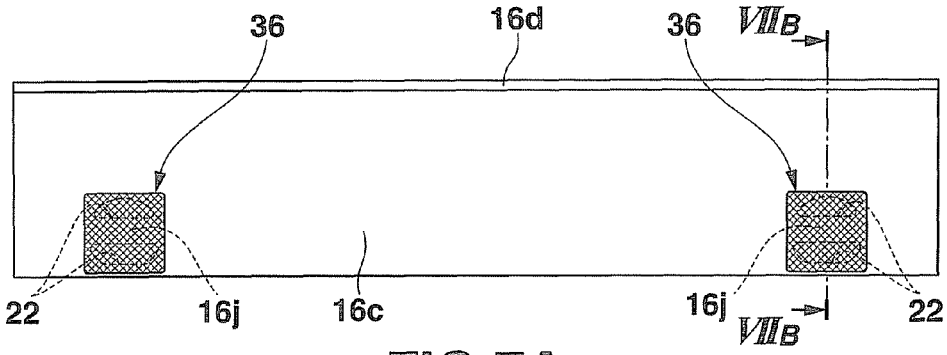
FIG. 7A is a schematic bottom view of the bottom plate of FIG. 6A, in which two speakers are removed and openings corresponding to two speakers and opening reinforcing members are exposed.
Figure 7B:
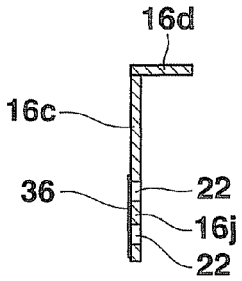
FIG. 7B is a schematic cross-sectional view along a line VIIB-VIIB in FIG. 7A.

In this embodiment, each of the openings 22 located near the both sides of the rear half of the lower surface region on the bottom plate 16*c* of the instrument main unit supporting member 16 are covered by an opening reinforcing member 36, as shown in FIGS. 7A and 7B in addition to FIG. 3. That is, the speaker 24 is attached to the lower surface region with its front side facing the opening 22 while the opening reinforcing member 36 is sandwiched between the front side of the speaker 24 and a peripheral area around the opening 22 on the lower surface region of the bottom plate 16*c*, as shown in FIGS. 6A and 6B in addition to FIG. 3.

The opening reinforcing member 36 is structured to transmit the sounds from the speaker 24 and to reinforce the peripheral area around the opening 22 in the bottom plate 16*c* of the instrument main unit supporting member 16. In this embodiment, the opening reinforcing member 36 is provided by a rigid sheet member in which many small holes are formed. Such a sheet member can be a punching metal sheet, a porous plastic sheet or a fiber reinforced porous plastic sheet, and is fixed to the peripheral area around each opening 22 in the lower surface region of the bottom plate 16*c* by a well known fixing means such as an adhesive or fixing screws.

The opening reinforcing member 36 prevents foreign matters such as dust from entering toward the front side of the speaker 24 through the opening 22 in the bottom plate 16*c*, and as a result, prevents a degradation in a performance of the speaker 24 caused by the foreign matters.

In the electronic keyboard instrument 10 according to the embodiment and structured as described above, when the player presses any one of the white keys 18*a* and black keys 18*b* of the keyboard 18 while the fallboard 28 is located at its open position as shown in FIG. 3, the switch pressing portion 18*m* of the pressed white key 18*a* or black key 18*b* presses the movable contact member MC of the corresponding switch 18*k*. The pressed movable contact member MC brings the movable contact point into contact with the corresponding fixed contact point in the control circuit of the control circuit board 18*n* while the pressed movable contact member MC generates an elastic resistance corresponding to its shape. This contact causes the control circuit to generate an electrical signal corresponding to the pressed white key 18*a* or black key 18*b*.

The elastic resistance generated by the pressed movable contact member MC applies a force of repulsion to the pressed white key 18*a* or black key 18*b*, and applies a key-touch feeling to the player's finger pressing the key. The pressed white key 18*a* or black key 18*b* further presses the front end part of the hammer member 18*g* corresponding thereto, rotates the corresponding hammer member 18*g* on the rotation shaft 18*h*, and moves the rear end part of the corresponding hammer member 18*g* upward from the stopper 18*s* fixed to the stopper fixing portion 18*i*. At this time, the rotating hammer member 18*g* applies a force of repulsion to the pressed white key 18*a* or black key 18*b* with the principle of leverage, and applies another different key-touch feeling to the player's finger pressing the white key 18*a* or black key 18*b*.

The electrical signal is sent from the control circuit to the speaker drive unit 24*a* of at least one of the speakers 24 through the not-shown wiring. The speaker drive unit 24*a* produces a sound corresponding to the electrical signal from the control circuit through the speaker 24 corresponding thereto.

The sound from the front side of the speaker 24 is transmitted to the rear half of the internal space 16*i* of the instrument main unit supporting member 16 through the opening reinforcing member 36 facing the speaker 24 and the opening 22 reinforced by the opening reinforcing member 36, and is transmitted from the rear half to the front half in the internal space 16*i* through clearances in the instrument main unit 14 and clearances between the instrument main unit 14 and the inner surface of the internal space 16*i*, as indicated by two-dot chain lines with arrows in FIG. 3. Finally, the sound from the front side of the speaker 24 is radiated from the upper opening of the front half of the internal space 16*i* to the external space, as indicated by the two-dot chain lines with arrows in FIG. 3. Therefore, the player can hear the sound produced by the electronic keyboard musical instrument 10 when the player plays it, from the upper opening of the front half of the internal space 16*i* of the instrument main unit supporting member 16 through clearances between the white keys 18*a* and the black keys 18*b* of the keyboard 18, that is, from the tips of it's fingers.

The sound from the rear side of the speaker 24 is radiated downward from the bottom plate 16*c* of the instrument main unit supporting member 16 through the sound radiating slits 26*a* of the speaker protective cover 26 covering the rear side of the speaker 24, as indicated by the two-dot chine lines with arrows in FIG. 3. Therefore, the player can further hear the sound produced by the electronic keyboard instrument 10 when the player plays it from an under side of the bottom plate 16*c* of the instrument main unit supporting member 16, that is, from the player's own feet.

The player of the electronic keyboard musical instrument 10 according to the embodiment and structured as described above can produce a sound through at least one speaker 24 when the player presses any one of the white keys 18*a* and black keys 18*b* of the keyboard 18, and can hear the produced sound not only from the tips of its fingers placed on the keyboard 18, but also from the player's own feet under the bottom plate 16*c* of the instrument main unit supporting member 16. As a result, the player can feel like that the player is surrounded with the sound produced by itself through the speaker 24. Further, since the peripheral area around the opening 22 in the bottom plate 16*c* of the instrument main unit supporting member 16 is reinforced by the opening reinforcing member 36, degradation of the quality of the sound discharged from the front side of the speaker 24 and passing through the opening 22 corresponding to the front side of the speaker 24 is lowered.

Further, in the electronic keyboard musical instrument 10 of this embodiment, since the peripheral area around the opening 22 in the bottom plate 16*c* of the instrument main unit supporting member 16 is reinforced by the opening reinforcing member 36, it is possible to provide the bridge-shaped part 16*j* crossing the opening 22 and to place the stopper fixing portion 18*i* supporting the stopper 18*s* for the rear end part of the hammer member 18*g* on the inner surface of the bridge-shaped part 16*j*. This can reduce the whole area of the inner surface of the bottom plate 16*c* of the instrument main unit supporting member 16 in comparison with a case where the stopper fixing portion 18*i* is placed in a part other than the opening 22 on the bottom plate 16*c* of the instrument main unit supporting member 16. Further, when the rear end part of the hammer member 18*g* hits the stopper 18*s*, a noise is not generated around the bridge-shaped part 16*j* and/or the opening 22 in the bottom plate 16*c* of the instrument main unit supporting member 16.

In the electronic keyboard musical instrument 10 described hereinbefore with reference to FIGS. 1 to 8B, the hammer member 18*g* is used for each of the white keys 18*a* and black keys 18*b* to apply an additional key-touch feeling to the player's finger pressing each of the white keys 18*a* and black keys 18*b* while the player plays the electronic keyboard musical instrument 10. However, the hammer member 18*g* can be omitted for saving the manufacturing cost of the electronic keyboard musical instrument 10.

In this case, as shown in FIG. 3, it is of course possible to omit the stopper 18*s* hit by the rear end part of the hammer member 18*g* at its initial position, and it is also possible to omit the stopper fixing portion 18*i* of the keyboard chassis 18*c* to which the stopper 18*s* is fixed. Further, it is unnecessary to provide the bridge-shaped part 16*j* for supporting the stopper fixing portion 18*i*, in each of the openings 22 for the speakers 24 in the bottom plate 16*c* of the instrument main unit supporting member 16.

In the electronic keyboard musical instrument 10 according to this embodiment, data of music scores is previously stored in a storage element included in the control circuit on the control circuit board 18*n*, and the control circuit board 18*n* includes a not-shown music title selection switch for selecting any one of music titles corresponding to the music scores stored in the storage element of the control circuit. And, when a player intends to play one of the music scores stored in the storage element through the electronic keyboard musical instrument 10, the player can select the music title corresponding to the music score which is to be played, by using the not-shown music title selection switch just before playing the music score. In this case, the control circuit on the control circuit board 18*n* of the electronic keyboard musical instrument 10 can show the player an order and timing of pressing the white keys 18*a* and black keys 18*b* of the keyboard 18 necessary for playing the selected music score by lighting the light-emitters 18*j* according to the order and timing of pressing the keys.

In the electronic keyboard musical instrument 10 according to this embodiment, the openings 22 for the speakers 24 are formed in the outer surface of the bottom plate 16*c* of the instrument supporting member 16. However, the opening 22 for the speaker 24 may be formed in the outer surface of at least one of the top plate 16*f*, the front plate 16*d*, the rear plate 16*e* and the side plates 16*a* and 16*b*, these plates surrounding the internal space 16, and further the speaker 24 may be attached to the outer surface with the front side of the speaker 24 facing the opening 22.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electronic keyboard musical instrument which is placed on a supporting surface when it is used, comprising:

an instrument main unit which includes a keyboard having a plurality of keys and which generates electrical signals in response to depressions of the keys of the keyboard;

a speaker which has a front side and a rear side and which produces sounds corresponding to the electrical signals from the instrument main unit; and an instrument main unit supporting member which is placed on the supporting surface and which includes an outer surface facing an external space, the outer surface including a lower surface region facing the supporting surface, an internal space surrounded by the outer surface and housing the instrument main unit at a position apart upward from the supporting surface, and an opening formed in the lower surface region of the outer surface and communicating the internal space with the external space, wherein the speaker is attached to the lower surface region of the outer surface with the front side facing the opening, and wherein the instrument main unit further comprises a plurality of key-responsive moving members which move in response to movements of the keys, and a moving range restricting member which is provided on the instrument main unit supporting member to cross the opening in the instrument main unit supporting member and which contacts each of the key-responsive moving members to restrict a moving range of each key-responsive moving member.

2. The electronic keyboard musical instrument according to claim 1, further comprising an opening reinforcing member which covers the opening in the instrument main unit supporting member, which transmits the sounds from the speaker, and which reinforces a peripheral area around the opening in the instrument main unit supporting member.

3. The electronic keyboard musical instrument according to claim 2, wherein the opening reinforcing member includes a punching metal sheet.

4. The electronic keyboard musical instrument according to claim 1, further comprising a speaker protective cover which covers the speaker on a peripheral area around the opening in the outer surface of the instrument main unit supporting member, which protects the speaker from an external force, and which transmits substantially all registers of the sounds from the rear side of the speaker.

* * * * *